United States Patent [19]

Harding

[11] Patent Number: 4,903,287

[45] Date of Patent: Feb. 20, 1990

[54] RADIATION SOURCE FOR GENERATING ESSENTIALLY MONOCHROMATIC X-RAYS

[75] Inventor: Geoffrey Harding, Hamburg, Fed. Rep. of Germany

[73] Assignee: U.S. Philips Corporation, New York, N.Y.

[21] Appl. No.: 194,631

[22] Filed: May 16, 1988

[30] Foreign Application Priority Data

May 18, 1987 [DE] Fed. Rep. of Germany ..... 3716618

[51] Int. Cl.[4] ..... H01J 35/00

[52] U.S. Cl. ..... 378/119; 378/156; 378/161; 378/141; 378/143

[58] Field of Search ..... 378/119, 140, 141, 143, 378/156, 161, 44

[56] References Cited

U.S. PATENT DOCUMENTS

| | | | |
|---|---|---|---|
| 1,655,455 | 1/1928 | Coolidge | 378/141 |
| 2,309,566 | 1/1943 | Atlee et al. | 378/140 |
| 2,343,730 | 3/1944 | Atlee | 378/143 |
| 3,567,928 | 3/1971 | Davies et al. | 378/119 |
| 3,920,999 | 11/1975 | Drexler et al. | 378/119 |

FOREIGN PATENT DOCUMENTS

| | | | |
|---|---|---|---|
| 1443048 | 7/1976 | United Kingdom | 378/119 |

*Primary Examiner*—Craig E. Church
*Assistant Examiner*—John C. Freeman
*Attorney, Agent, or Firm*—Paul R. Miller

[57] ABSTRACT

The invention relates to a fluorescence radiation source in which an anode which encloses a member is struck by electrons on its side which faces the member and in which the primary X-ray radiation generated in the anode generates fluorescence radiation in the member. The member is preferably arranged within an enclosing shield which keeps scattered electrons remote from the member.

21 Claims, 1 Drawing Sheet

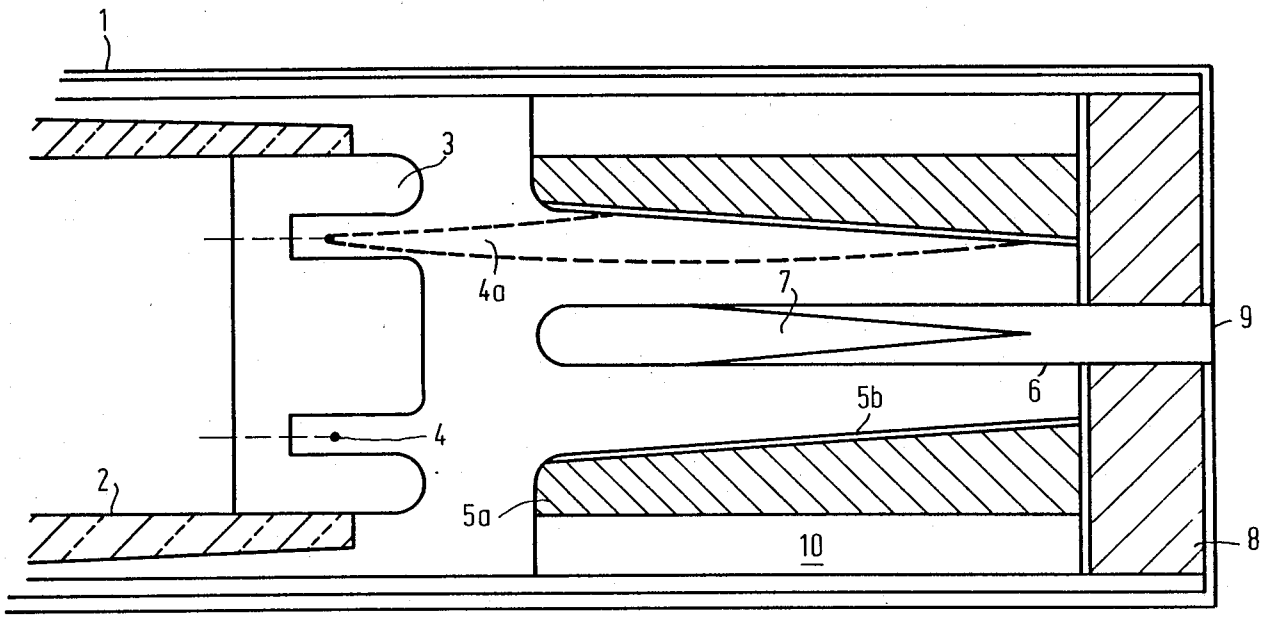
1
2
3
4
4a
5a
5b
6
7
8
9
10

RADIATION SOURCE FOR GENERATING ESSENTIALLY MONOCHROMATIC X-RAYS

The invention relates to a radiation source for generating essentially monochromatic X-ray radiation, comprising a cathode for generating electrons which are accelerated onto an anode and also comprising a conical member which is enclosed by the anode and which converts X-ray radiation incident thereon into fluorescence radiation, the apex of the conical member being directed towards a radiation exit.

A radiation source of this kind is known from German Offenlegungschrift DE-OS No. 22 59 382. In this radiation source the monochromatic radiation is formed by the fluorescence radiation emerging from the member when the latter is struck by primary X-ray radiation. The primary X-ray radiation is suppressed by a suitably positioned collimator.

The anode of the known radiation source is constructed as a so-called transmission anode, i.e. its outer surface is struck by electrons and the X-ray radiation incident on the conical member emerges from the inner surface. The thickness of the anode must be a compromise between conflicting requirements: on the one hand, as many electrons as possible must be absorbed, while on the other hand the X-ray radiation generated must be attenuated as little as possible. This results in comparatively small thicknesses, leading to poor transfer of heat and hence limited load-taking capacity, i.e. limited maximum dissipation of the tube.

It is the object of the invention to construct a radiation source of the kind set forth so that a higher thermal load-taking capacity is achieved.

This object is achieved in accordance with the invention in that the inner surface of the anode which faces the member is struck by the electrons emitted by the cathode.

Because only the inner surface of the anode of this construction is exposed to the electron bombardment and forms the emergent point for the X-ray radiation, the dissipation of heat from the anode can be substantially improved, for example by means of liquid cooling and/or by using a comparatively thick-walled anode.

In a further elaboration of the invention, the inner surface of the anode which faces the member is shaped as a truncated cone which is tapered towards the radiation exit. In this version, where the narrower end of the anode faces the radiation exit and the wider end faces the cathode, a comparatively uniform electron distribution is obtained across the anode surface, so that the thermal load-taking capacity is also more uniform.

In a further elaboration, the anode consists of a solid metal block whose inner surface is provided with a heavy-atom metal layer. The material of the metal block of the anode may be a thermally suitably conductive material, for example copper, while the metal on the inner surface can be chosen so as to obtain an as high as possible fluorescence radiation yield.

In another elaboration, the material for the inner surface of the anode and the outer surface of the member is chosen so that the energy of the characteristic X-ray radiation emitted by the anode is slightly higher than the K-absorption edge of the member. Because X-ray radiation whose energy is slightly higher than the absorption edge of a material is converted therein into fluorescence radiation to a very high degree, a higher intensity of the fluorescence radiation is thus obtained.

In another elaboration, between the anode and the member there is arranged a cylindrical metal shield which encloses the member and which only slightly attenuates the X-ray radiation. The shield absorbs the secondary electrons and prevents X-ray radiation having an energy which deviates from the energy of the fluorescence radiation from being generated thereby in the member.

The invention will be described in detail hereinafter with reference to the drawing which is a cross-sectional view of a part of the radiation source in accordance with the invention.

The rotationally symmetrically constructed radiation source comprises a cylindrical housing 1 whereto there is secured, via a ceramic insulator 2, a cathode system 4 which comprises an annular or spiral-shaped cathode 4. During operation the cathode emits an electron beam (denoted by broken lines) *4a* which is incident on the inner surface *5b* of an anode which is formed as the surface of a truncated cone. This results in a comparatively uniform distribution of the electrons across the inner surface of the anode.

The anode consists of a metal block *5a* of a thermally suitably conductive material, preferably copper, whose inner surface *5b* is provided with a heavy-atom metal layer in which X-ray radiation is produced by the electron bombardment.

Through a thin cylindrical shield 6 the X-ray radiation is incident on a target 7 which is constructed so as to be conical at its end remote from the cathode and which converts the incident primary radiation into essentially monochromatic fluorescence radiation.

The shield 6 which supports the target 7 serves to keep scattered electrons remote from the target 7. Such scattered electrons would form an undesirable bremsstrahlung spectrum upon incidence on the target 7. In order to prevent the shield 6 on the one hand from absorbing too much X-ray radiation and on the other hand from emitting X-ray radiation itself due to incident scattered or secondary electrons, the wall of the shield is constructed to be as thin as permitted from a mechanical point of view and is made of a low-atom material, for example titanium.

The open end of the shield, facing the apex of the conical target 7, forms the radiation exit 9 for the fluorescence radiation generated. The primary X-ray radiation emerging from the anode *5a, 5b* is suppressed by a collimator device 8, in the center of which the shield 6 is mounted in a vacuumtight manner. The collimator is made of a radiation-absorbing material or of a plurality of plates of such a material which are staggered in the direction of the symmetry axis, the thickness of the collimator or the distance between the outer plates of the collimator being chosen so that primary X-ray radiation emerging from the anode must be incident on the collimator before reaching the radiation exit 9.

The energy of the fluorescence radiation depends on the material of the target. When tantalum is chosen, the energy of the fluorescence radiation amounts to 57.5 keV ($K\alpha_1$-line). When fluorescence radiation of higher or lower energy is to be generated, the tantalum target must be replaced by a target which is made of an element or an alloy having a higher or lower atomic number, respectively. The tube voltage (expressed in kV) must always be approximately twice as high as the energy of the fluorescence radiation (expressed in keV). In order to enable the use of targets which consist of different materials in order to generate monochromatic radiation of different wavelengths, the target is preferably detachably connected to the shield, for example by screwing. The shield must then be constructed so that it hermetically seals the interior of the evacuated housing of the radiation source from the environment.

The layer 5b in which the primary X-ray radiation is generated has a high atomic number and is preferably chosen so that the energy of the characteristic radiation generated in this layer is lightly higher than the K-absorption edge of the target 7, because a particularly good conversion into fluorescence radiation is then obtained. When the target is made of tantalum (K-absorption edge at 67.4 keV), this condition is satisfied by a layer 5b of gold (K$\alpha$-line at 68.8 keV).

As has already been stated, the layer 5b is provided on a solid metal block 5a which is preferably made of copper. The rear of this copper block is cooled by means of a cooling liquid which enters (in a manner not shown) a cavity 10 around the copper block from the outside, the cavity being hermetically sealed from the interior of the tube. Because the anode 5a, 5b and the housing 1 and the collimator 8 carry ground potential, water is preferably used as the cooling liquid. Instead of a metal block which is enclosed by a cavity for cooling, use can alternatively be made of a metal block in which cooling ducts, for example spiral-shaped ducts, are already present. The cooling surface and hence also the maximum electrical power that can be applied can thus be increased.

The fluorescence radiation generated by the target 7 is not fully monochromatic. This is due to the fact that not only the desired K$\alpha$-lines are excited, but also other lines, for example the higher-energetic K$\beta$-line or L-lines of an essentially lower energy. The K$\beta$-line is suppressed by means of a radiation filter which is arranged in the radiation exit and which is made of a material whose absorption edge is situated between the K$\alpha$-line and the K$\beta$-line. In the case of a tantalum target, filters made of ytterbium or thulium are suitable radiation filters. Any weak lines can be suppressed by means of the same filter or by means of a filter which is made of a material having a lower atomic number and which is proportioned so that the desired K$\alpha$-line is only insignificantly suppressed, while the L-lines are suppressed to a high degree.

What is claimed is:

1. A radiation source for generating essentially monochromatic x-ray radiation comprising (a) cathode means for generating accelerated electrons, (b) anode means receiving said accelerated electrons for forming a primary beam of x-rays, said anode means having an elongated, inner surface facing said cathode means to receive said accelerated electrons and to form said primary beam of x-ray all along said elongated inner surface, (c) a conical member spaced from said inner surface of said anode means for forming fluorescence radiation from said primary beam of x-rays, (d) a radiation exit means for passing said fluorescence radiation, wherein said conical member has a conical apex directed toward said radiation exit, and (e) cylindrical shield means for enclosing said conical member in a sealing manner, said cylindrical shield means being connected to said radiation exit means.

2. A radiation source according to claim 1, wherein said elongated, inner surface of said anode means has a truncated conical shape tapered toward said radiation exit means.

3. A radiation source according to claim 2, wherein said anode means includes a solid metal block having a hollow portion surrounding said conical member to constitute said elongated, inner surface, said inner surface being a heavy atom metal layer.

4. A radiation source according to claim 3, wherein said elongated, inner surface of said anode means is a material emitting characteristic x-ray radiation of a predetermined energy, and wherein said conical member has an outer surface with a K-absorption edge slightly lower than said predetermined energy.

5. A radiation source according to claim 4, wherein said material of said elongated, inner surface is gold, and said conical member is tantalum.

6. A radiation source according to claim 4, wherein said cylindrical shield means is a material which only slightly attenuates said primary beam of x-rays.

7. A radiation source according to claim 6, wherein said cylindrical shield means supports said conical member, and wherein said cylindrical shield means forms a vacuum-tight seal.

8. A radiation source according to claim 7, wherein said cylindrical shield means opens at said radiation exit means, and wherein said conical member is detachably connected to said cylindrical shield means.

9. A radiation source according to claim 8, wherein a filter is disposed over said radiation exit means, said filter being of a material having an absorption edge between a K$\alpha$-line and K$\beta$-line of said conical member.

10. A radiation source according to claim 9, wherein said anode means has an outer surface, said outer surface being cooled by a cooling liquid.

11. A radiation source according to claim 10, wherein said cathode means is disposed at a side of said anode means remote from said radiation exit means, and wherein said cathode means is disposed in one of an annular or a spiral shape.

12. A radiation source according to claim 11 wherein said cathode means is connected to a negative, high voltage potential, and said anode means is connected to ground potential, and wherein said cooling liquid is water.

13. A radiation source according to claim 1, wherein said elongated, inner surface of said anode means is a material emitting characteristic x-ray radiation of a predetermined energy, and wherein said conical member has an outer surface with a K-absorption edge slightly lower than said predetermined energy.

14. A radiation source according to claim 13, wherein said material of said elongated, inner surface is gold, and said conical member is tantalum.

15. A radiation source according to claim 1, wherein said cylindrical shield means is a material which only slightly attenuates said primary beam of x-rays.

16. A radiation source according to claim 15, wherein said cylindrical shield means supports said conical member, and wherein said cylindrical shield means forms a vacuum-tight seal.

17. A radiation source according to claim 15, wherein said cylindrical shield means opens at said radiation exit means, and wherein said conical member is detachably connected to said cylindrical shield means.

18. A radiation source according to claim 1, wherein a filter is disposed over said radiation exit means, said filter being of a material having an absorption edge between a K$\alpha$-line and K$\beta$-line of said conical member.

19. A radiation source according to claim 1, wherein said anode means has an outer surface, said outer surface being cooled by a cooling liquid.

20. A radiation source according to claim 19 wherein said cathode means is connected to a negative, high voltage potential, and said anode means is connected to ground potential, and wherein said cooling liquid is water.

21. A radiation source according to claim 1, wherein said cathode means is disposed at a side of said anode means remote from said radiation exit means, and wherein said cathode means is disposed in one of an annular or a spiral shape.

* * * * *